United States Patent [19]

Rudy et al.

[11] Patent Number: 4,678,403

[45] Date of Patent: Jul. 7, 1987

[54] LIQUID LEVEL SENSOR FOR CONTROLLING PUMP OPERATION

[76] Inventors: Richard M. Rudy, 305 Timbercove Cir., Longwood, Fla. 32750; Thomas J. Fitzgerald, 100 Elizabeth Ave., Altamonte Springs, Fla. 32701

[21] Appl. No.: 761,532

[22] Filed: Aug. 1, 1985

[51] Int. Cl.[4] ..... F04B 49/00

[52] U.S. Cl. ..... 417/12; 417/36; 307/118; 318/482

[58] Field of Search ..... 340/620; 137/192; 417/12, 36; 307/118; 318/482

[56] References Cited

U.S. PATENT DOCUMENTS

| | | | |
|---|---|---|---|
| 3,397,715 | 8/1968 | Fathauer | 340/620 |
| 3,502,899 | 3/1970 | Jones | 417/36 |
| 3,800,205 | 3/1974 | Zalar | 417/36 |
| 3,811,051 | 5/1974 | Merrell | 307/118 |
| 4,171,932 | 10/1979 | Miller | 417/36 |
| 4,182,363 | 1/1986 | Fuller | 137/392 |
| 4,205,237 | 5/1980 | Miller | 340/620 |
| 4,316,174 | 2/1982 | Sutton et al. | 340/620 X |
| 4,382,231 | 5/1983 | Miller | 340/620 |
| 4,479,116 | 10/1984 | Kobayaski | 340/620 |
| 4,550,261 | 10/1985 | Hormel et al. | 307/118 |
| 4,600,844 | 7/1986 | Atkins | 307/118 |

*Primary Examiner*—Carlton R. Croyle
*Assistant Examiner*—Paul F. Neils
*Attorney, Agent, or Firm*—Howard W. Califano

[57] ABSTRACT

The invention concerns a bilge pump control system. Sensing of water level in the bilge is accomplished by the conduction of current (on the order of one milliampere) between two stainless steel probes. The probes are mounted in a triangular package which is placed in the boat bilge. When immersed, a conduction path is provided between the probes. One edge of the package is aligned with the probes to enhance water run-off. An associated circuit is activated when the conduction path is present (when the probes are immersed) which operates the bilge pump in a time-hysteresis fashion.

5 Claims, 3 Drawing Figures

LIQUID LEVEL SENSOR FOR CONTROLLING PUMP OPERATION

BACKGROUND AND SUMMARY OF THE INVENTION

The invention concerns an electronic circuit having an on-and-off time hysteresis for controlling the operation of a boat bilge pump, and having two probes which sense water level in the bilge.

Typically, boat bilge pump control systems consist of an impellar-type DC water pump, controlled by either a manual switch or a mechanical switch activated by a float mechanism. As the water level in the bilge rises, the float naturally rises until the float reaches a pre-determined point, and a mechanical switch is activated to turn on the pump. The switch remains in the on position and the motor active until the water level in the bilge drops to a second pre-determined point to cause the mechanical switch to disengage and turn off the motor. In such systems, the switch per se is unreliable due to contact degradation caused by switching an inductive load. Float-activated systems may be become sticky in operation due to small pieces of debris and contaminants, such as seaweed, sand, dirt, wood chips and silt which restrict the motion of the mechanical system. Since failure of the switch or float can result in the boat sinking, (for example, when unattended at a dock or slip) it is common practice to replace the switch and float annually. Liquid mercury switches are also available, which are more reliable, but are more costly.

U.S. Pat. No. 4,222,711 and 4,357,131 disclose the use of two electrodes for sensing a high-water level and to regulate the actuation of a pump. A timing circuit is provided so that the pump is actuated for a pre-determined time before it is shut off. The teaching of multiple-actuation pumps as regulated by circuits having complex configurations of probes, is separately found in U.S. Pat. Nos. 3,509,825; 3,787,733; and 4,105,367.

SUMMARY AND OBJECTS OF THE INVENTION

A potted package is mounted on the floor of a bilge, such that when immersed in water, current conducts through the water between two stainless steel probes or rods of the package. An associated circuit is activated which allows the current to travel and energize a pump motor until the water level recedes, preventing conduction between the probes which shuts the pump off. A R. C. network within the circuit provides time delay when the motor is turned on and off, allowing the water to rise slightly higher than the package before the pump is turned on and slightly below the package before the pump is turned off. Thus, the pump is operated in a time-hysteresis mode to prevent unnecessary multiple actuations of the pump which might otherwise be caused by sloshing or splashing of the water within the bilge. The probe rods and circuit are mounted in a waterproof package with a sloped face, to provide fast and complete run off of the water, preventing accumulation of silt, sand, etc. If allowed to accumulate, sand and silt can retain moisture, resulting in an erroneous conduction path between the probe rods.

It is an object of this invention, therefore, to:

(a) provide a bilge pump operated in a time-hysteresis mode to prevent unnecessary multiple actuations;

(b) provide a boat bilge pump control system with on and off points which are a function of a percentage of the supply voltage;

(c) provide a bilge pump control system having a circuit which is equally applicable to all standard battery voltages from 6 to 32 volts DC;

(d) provide a control system having a circuit, wherein the power required in a sensing mode (pump off) is in the microampere range; and (e) provide a circuit assembly and probe which is potted with a slanted top surface for fast and complete water run off.

DETAILED DESCRIPTION OF THE DRAWINGS

Figure 1:
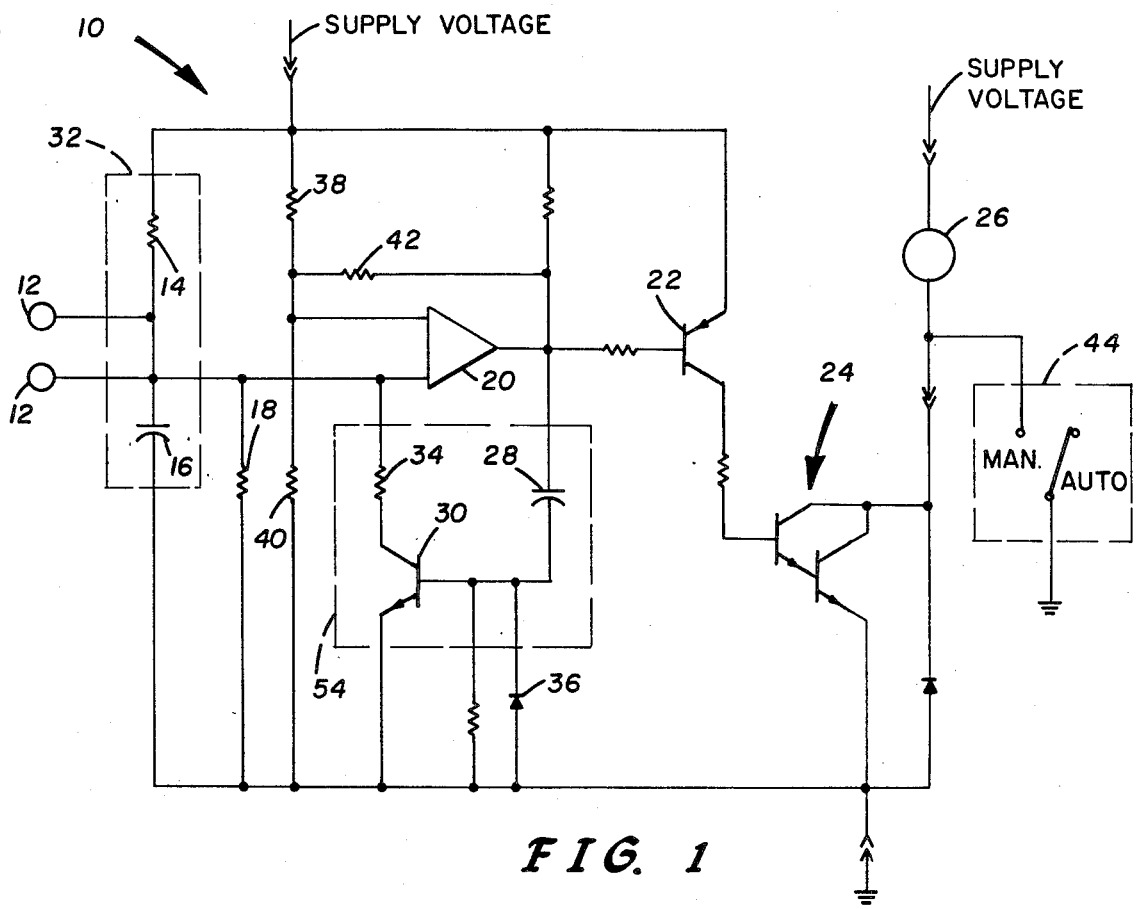
FIG. 1 shows a circuit which operates a bilge pump in a time-hysteresis fashion.

FIG. 1 depicts the invented circuit generally at 10. The sensing of the water level is accomplished by the conduction of current (on the order of one milliampere) between to stainless steel rods or probes 12, which are mounted to the floor of a boat bilge. When the probes 12 become immersed in water, a high-conduction electrical path between the probes 12 is present; when not immersed, an essentially open circuit exists between the probes 12.

When the probes 12 are immersed in water or any other conductive liquid, a completed circuit path exists between the probes 12 causing a current flow through the resistor 14 charging capacitor 16 as long as the probes 12 remain immersed in the liquid. If the liquid level falls below the level of the probes 12, the conductive path is opened and the charge on the capacitor 16 dissipates through the resistor 18. Hence, the probes 12 must remain immersed in the liquid until the charge on the capacitor 16 rise above the threshold voltage of the comparator 20. The comparator 20 output then conducts to ground, turning on switching transistor 22 and subsequently transistor 24, which results in turning on the pump motor 26, reducing the level of the liquid. When the liquid level falls below the level of the probes 12, capacitor 16 then begins to discharge through resistor 18. When the voltage on capacitor 16 decreases below the turn-off threshold of the comparator 20, the comparator 20 output turns off, resulting in transistors 22, 24, and the pump motor 26 turning off, completing the cycle. In addition, the rising voltage that occurs when the comparator 20 turns off is differentiated by a reset circuit 54. A capacitor 28, momentarily turns on transistor 30, which completely discharges capacitor 16 and resets the input timing circuit 32 for the next cycle. Resistor 34 is chosen with a very small value to limit the amount of peak current conducted by transistor 30. Diode 36 protects transistor 30 from reverse voltage transients produced when the negative-going voltage output of the comparator 20 occurs at pump turn-on time.

The values of the timing circuit 32 elements are selected to provide an approximate 5 second time constant to 60% of the supply voltage. The time constant for capacitor 16 and resistor 18 is also approximately 5 seconds, for capacitor 16 to discharge from 80% to 40% of the supply voltage. The 80% value represents approximately the voltage level that capacitor 16 will achieve while the probes 12 remain immersed during pump run time. The values of resistors 38, 40, and 42 are selected to provide an input voltage on the positive terminal of the comparator 20 equal to 60% of the supply voltage when the comparator 20 is off, and 40% of the supply voltage when the comparator 20 is on, providing comparator thresholds correspond to timing circuit 32 time constants. This provides a pump turn-on time delay of approximately 5 seconds of complete probe immersion, and a pump run-on of also of approximately 5 seconds following probe de-immersion to drop the liquid level well below the level of the probes 12. This action eliminates nuisance pump turn-on cycles and pump hunting when the pump turns on almost immediately following turn-off.

The circuit 10 of FIG. 1 is entirely ratiometric in operation. That is, all on and off points are a function of a percentage of the supply voltage, as opposed to absolute voltage values. As such, this circuit works equally well, with the same timing performance, at supply voltages from approximately 3 VDC up to the breakdown voltage of the transistors, which can be as high as 60 VDC. From a practical point of view, the circuit is equally applicable to all standard battery voltages from 6 to 32 VDC with no changes necessary. The power required by the circuit in its sensing mode (pump off) is in the microampere range, determined primarily by the values of resistors 38, 40 and 42, and the current requirements of the comparator 20. This is a very important parameter when the pump control system is used in long-term unattended applications such as boats at dock, where the pump control system cannot demand an appreciable capacity of the boat battery.

Switch 44 is typically located on the dashboard of the boat and is used to select constant running of the pump when set to the MAN position, or controlled pump operation when set to the AUTO position.

Figure 2:
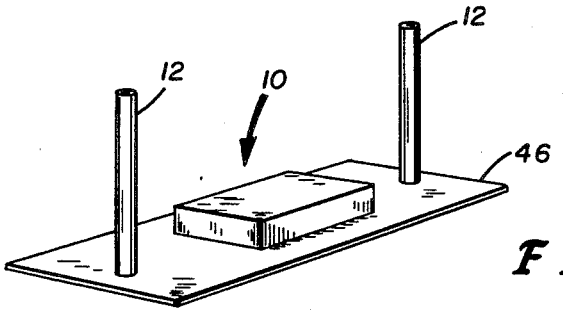
FIG. 2 reveals the internal construction of the probes and circuit, as mounted.
Figure 3:
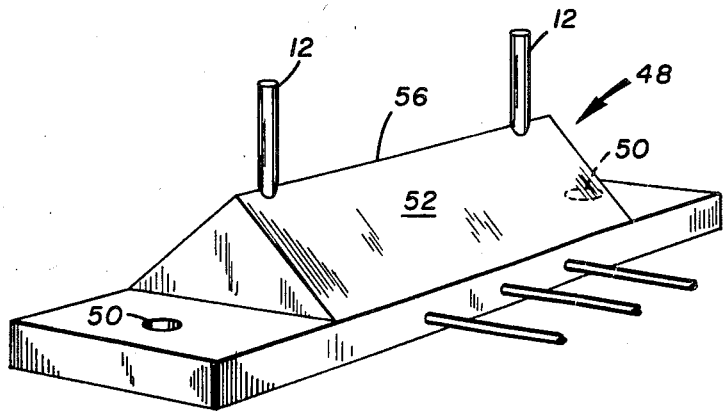
FIG. 3 shows the assembly of FIG. 2 in its packaged form.

The internal packaging of the pump control system is shown in FIG. 2. The circuit 10 and probe rods 12 are mounted on a small printed-circuit card 46. In FIG. 3, the system is shown as enclosed in a potted package 48 providing a rigid, waterproof assembly with mounting holes 50. The top portion 52 of the potted assembly is triangular in cross-section between the probe rods 12. A surface of the top portion 52 is sloped down from the probes 12 to provide fast and complete water runoff, to further immunize the pump from cycling due to sloshing water, and to essentially self-clean the surface between the probe rods 12. The sloped surface of the top portion 52 prevents accumulation of silt and sand that can retain moisture and eventually provide an erroneous conduction path between the probes. In accordance with the present invention, a sharp edge 56 of the potted package 48 is aligned between the probes 12. Since it is not possible to form a conduction path along the sharp edge 56 of the sloped portion 52 (water cannot accumulate there), it is apparent that the entire potted package 48 must be immersed before current will conduct between the probes 12. A flat surface, if used instead of the sharp edge 56, could provide many conductive paths, and in fact, may allow water to pool between the probes.

Other modifications are apparent to one skilled in the art, the scope of the invention being defined by the appended claims. For instance, the triangular top portion 52 may have one vertical face and sloped face, rather than two sloping faces as shown in FIG. 3, the bilge may comprise any liquid containing structure from which the liquid is to be pumped.

What is claimed is:

1. A control system connected to a voltage supply and to a pump for pumping a liquid, the system comprising:

two probes displaced a distance from each other, which when immersed in the liquid are connected by a conductive path created through the liquid;

a timing means for charging a capacitor when said probes are immersed in a liquid;

a discharging means for discharging said capacitor when said probes are not immersed in a liquid;

a comparator means for turning "on" when said capacitor is charged to a certain first percentage of supply voltage and for turning from "on" to "off" when said capacitor is discharged to a certain second percentage of supply voltage; and, a switching means operably coupled to said comparator means and the pump for activating the pump while said comparator means is turned "on";

a reset means, operably coupled to said capacitor and said comparator means, for completely and rapidly discharging said capacitor, said reset means is triggered when said comparator means turns from "on" to "off".

2. A control system connected to a voltage supply and to a pump for pumping a liquid, the system comprising:

two probes displaced a distance form each other, which when immersed in the liquid are connected by a conductive path created through the liquid;

a timing means for charging a timing element when said probes are immersed in a liquid;

a discharging means for discharging said timing element when said probes are not immersed in a liquid;

a comparator means for turning "on" when said timing element is charged to a certain first percentage of supply voltage and for turning from "on" to "off" when said timing element is discharged to a certain second percentage of supply voltage;

a reset means, operably coupled to said timing means and said comparator means, for completely and rapidly discharging said timing element, said reset means is triggered when said comparator means turns from "on" to "off"; and, a switching means operably coupled to said comparator means and the pump for activating the pump while said comparator means is turned "on".

3. The system of claim 2, wherein said two probes are mounted in a package having a triangular cross-sectional portion, said two probes extending from an edge of said triagnular cross-sectional portion so that the faces of said triangular cross-sectional portion slope down from said probes.

4. A control system connected to a voltage supply and to a pump for pumping a liquid, the system comprising:

two probes displaced a distance from each other, which when immersed in the liquid are connected by a conductive path created through the liquid;

a timing means for charging a capacitor when said probes are immersed in a liquid;

a discharging means for discharging said capacitor when said probes are not immersed in a liquid;

a comparator means for turning "on" when said capacitor is charged to a certain first percentage of supply voltage and for turning from "on" to "off" when said capacitor is discharged to a certain second percentage of supply voltage; and, a switching means operably coupled to said comparator means and the pump for activating the pump while said comparator means is turned "on" and wherein said two probes are mounted in a package having a triangular cross-sectional portion, said two probes extending from an edge of said triangular cross-sectional portion so that the two faces of said triangular cross-sectional portion slope down from said probes.

5. A control system connected to a voltage supply and to a pump for pumping a liquid, the system comprising:

two probes displaced a distance from each other, which when immersed in the liquid are connected by a conductive path created through the liquid;

a timing means for charging a capacitor when said probes are immersed in a liquid;

a discharging means for discharging said capacitor when said probes are not immersed in a liquid;

a comparator means for turning "on" when said capacitor is charged to a certain first percentage of supply voltage and for turning from "on" to "off" when said capacitor is discharged to a certain second percentage of supply voltage, wherein said comparator means further comprises, a voltage reference means for providing a reference voltage that is a first percentage of supply voltage when said comparator is "off" and a second percentage of supply voltage when said capacitor is "on" , wherein said voltage reference means is a resistor bridge, a comparator operably coupled to said capacitor and said voltage reference means, the output from said comparator operably coupled to said switching means; and, a switching means operably coupled to said comparator means and the pump for activating the pump while said comparator means is turned "on".

* * * * *